United States Patent [19]

Morishita et al.

[11] Patent Number: 4,840,549

[45] Date of Patent: Jun. 20, 1989

[54] SCROLL COMPRESSOR WITH CONTROL OF DISTANCE BETWEEN DRIVING AND DRIVEN SCROLL AXES

[75] Inventors: Etsuo Morishita; Masayuki Kakuda, both of Amagasaki; Masahiro Sugihara, Wakayama; Tsutomu Inaba, Wakayama; Toshiyuki Nakamura, Wakayama; Tadashi Kimura, Wakayama, all of Japan

[73] Assignee: Mitsubishi Denki Kabushiki Kaisha, Tokyo, Japan

[21] Appl. No.: 204,253

[22] Filed: Jun. 9, 1988

Related U.S. Application Data

[63] Continuation-in-part of Ser. No. 12,375, Feb. 9, 1987, Pat. No. 4,753,582.

[30] Foreign Application Priority Data

Feb. 12, 1986 [JP] Japan ..... 61-28427

[51] Int. Cl.[4] ..... F04C 18/04; F04C 27/00

[52] U.S. Cl. ..... 418/55; 418/57; 418/188

[58] Field of Search ..... 418/55, 57, 107–109, 418/188

[56] References Cited

U.S. PATENT DOCUMENTS

| | | | |
|---|---|---|---|
| 3,600,114 | 8/1971 | Dvorak et al. | 418/57 |
| 3,884,599 | 5/1975 | Young et al. | 418/55 |
| 4,178,143 | 12/1979 | Thelen et al. | 418/57 |
| 4,551,078 | 11/1985 | Hiraga | 418/57 |
| 4,575,318 | 3/1986 | Blain | 418/57 |
| 4,585,402 | 4/1986 | Morishita et al. | 418/55 |

*Primary Examiner*—John J. Vrablik

*Attorney, Agent, or Firm*—Oblon, Fisher, Spivak, McClelland & Maier

[57] ABSTRACT

A scroll compressor comprising a driving scroll and a driven scroll which is combined with the driving scroll and is driven by the driving scroll through an Oldham's coupling, a partition plate fixed to a container for housing the structural elements such as scrolls and having a supporting pin provided at a position near the inner wall of the container, a movable bearing support which is placed below the partition plate and is engaged with the supporting pin so as to be swingable around the supporting pin, and which supports the driven scroll through a bearing, and a rotation controlling structure which causes a swinging movement of the movable bearing support around the supporting pin along with a driven scroll whereby the distance between the axial centers of said driving and driven scrolls is changed.

2 Claims, 5 Drawing Sheets

SCROLL COMPRESSOR WITH CONTROL OF DISTANCE BETWEEN DRIVING AND DRIVEN SCROLL AXES

BACKGROUND OF THE INVENTION

The present invention is a continuation-in-part of U.S. Pat. application Ser. No. 07/012,375 filed Feb. 9, 1987, now U.S. Pat. No. 4,753,582.

FIELD OF THE INVENTION

The present invention relates to a total system rotation type scroll compressor having a driving scroll and driven scroll.

DISCUSSION OF BACKGROUND

The principle of the scroll compressor has been known. The scroll compressor is a kind of a positive displacement type compressor in which a pair or scrolls are combined with each other to effect compression of a fluid.

In the ordinary scroll compressor, one of the scrolls is made stationary and the other is subject to an orbital movement with respect to the stationary scroll to effect the compression.

The principle of the total system rotation type scroll compressor in which both scrolls are respectively rotated around their own axial center, is also well known.

FIG. 6 shows the principle of the total system rotation type scroll compressor. A driving scroll 1 is caused to rotate around its own axial center $0_1$ by a driving source such as a motor, an engine, a turbine and so on. A driven scroll 2 is also caused to rotate around its axial center $0_2$ in synchronism with the rotation of the driving scroll 1. A compression chamber 3, which is formed by combining the driving and driven scrolls 1, 2, moves toward the rotation centers as the both scrolls rotate while the volume of the chamber 3 is gradually reduced. The pressure of a gas confined in the compression chamber 3 increases and a highly pressurized gas is discharged through a discharge port 2*c*.

FIG. 6*a* shows a state of the combined driving and driven scrolls 1, 2 at its moving phase of 0°, in which the gas is sucked in the compression chamber 3. As the scrolls rotate, they assume the moving phases of 90°, 180° and 270° successively, whereby the compression chamber 3 gradually shifts toward their revolution centers with the result of reduction in the volume of the gas. The two scrolls 1, 2 provide sealing portions by mutual contact of the side walls of the wrap plates 1*a*, 2*a* of the scrolls 1, 2. As shown in FIG. 6, the sealing portions 5 are in alignment with each other in the radial direction of the driving and driven scrolls 1, 2; namely, they always occupy a constant positional relation in a static state of the scrolls.

U.S. Pat. No. 3,884,599 schematically shows the conventional total system rotation type scroll compressor in FIG. 38. In the construction disclosed in the U.S. Patent, an Oldham's coupling is used to maintain a given phase between a driving scroll and a driven scroll.

In the conventional scroll compressor, there is no control means which controls gaps between the wrap plates of the scroll members. Accordingly, when a gap is produced between the wrap plates during the use of the scroll compressor, the gaps inviting reduction in efficiency of the compressor, it has no way to adjust the gaps.

SUMMARY OF THE INVENTION

It is an object of the present invention to provide a scroll compressor which enables a gap produced between a sealing portion on the wrap plates of the driving and driven scrolls to be adjusted; enables accuracy in machining of the structural elements of the scroll compressor to be reduced, and enables assembling work of the apparatus to be easy so that the productivity of the apparatus is improved.

The foregoing and the other objects of the present invention have been attained by providing a scroll compressor which comprises a sealing container, a driving scroll with a wrap plate, a driven scroll with a wrap plate, which is combined with the driving scroll to form a compression chamber therebetween, an Oldham's coupling for transmitting a driving force of the driving scroll to the driven scroll, a partition plate fixed to the container and having a supporting pin provided at a position near the inner wall of the container, a movable bearing support which is placed below the partition plate and is engaged with the supporting pin so as to be swingable around the supporting pin, and which supports the driven scroll through a bearing, and a rotation controlling means which causes a swinging movement of the movable bearing support around the supporting pin along with the driven scroll whereby the distance between the axial centers of the driving and driven scrolls is changed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
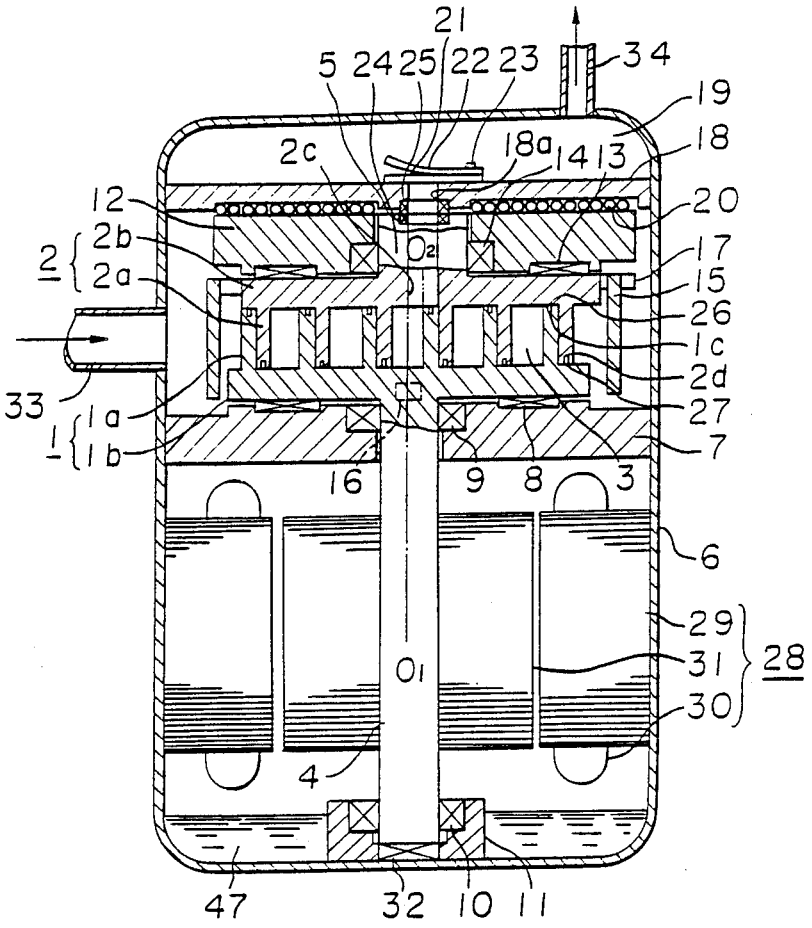
FIG. 1 is a longitudinal cross-sectional view of an embodiment of the scroll compressor according to the present invention.

Referring now to the drawings, wherein like reference numerals designate identical or corresponding parts throughout the several views, and more particularly to FIG. 1 thereof, there is shown a longitudinal cross-sectional view of the scroll compressor of the present invention. In FIG. 1, a driving scroll 1 is provided with a wrap plate 1*a* on a surface of its circular plate portion 1*b*. A driving shaft 4 is formed integrally with or is attached to the other surface of the circular plate portion 1*b*. A driven scroll 2 has a wrap plate 2*a* formed on a surface of a circular plate portion 2*b*. A shaft 5 is integrally formed with or attached to the other surface of the circular plate portion 2*b*. A discharge port 2*c* is formed through the circular plate portion 2*b* and the shaft 5. The driven scroll 2 is combined with the driving scroll 1 to form a compression chamber 3 in the combined wrap plates 1*a*, 2*a* (refer to FIG. 4).

A reference numeral 6 designates a sealing container and a numeral 7 designates a lower bearing support firmly connected to the container 6. The lower bearing support 7 supports the lower surface of the driving scroll 1 through a thrust bearing 8 and supports the driving shaft 4 through a bearing 9 to restrict the movement of the driving shaft in its radial direction. A bearing seat 11 (which may be a part of a frame body for an oil pump) is positioned at the bottom of the container 6 to support the lower part of the driving shaft 4 to restrict the movement of it in its radial direction. A movable bearing support 12 is provided at the upper part of the container so as to support through a thrust bearing 13 the driven scroll 2 from the top and supports the shaft 5 of the driven scroll 2 through a bearing 14 to restrict the movement of the shaft 5 in the radial direction.

A numeral 15 designates an Oldham's coupling which is placed surrounding the outer peripheries of the driving and driven scrolls 1, 2. The construction of the Oldham's coupling is shown as an exploded view in FIG. 2.

A pair of connecting grooves 15*a* (referred to as first grooves) are formed in the lower part of the Oldham's coupling 15 at diametrically opposing positions (at 180° symmetry). A pair of connecting grooves 15*b* (referred to as second grooves) are formed in the upper portion of the Oldham's coupling 15 at diametrically opposing positions (at 180° symmetry) and in the direction perpendicular to the line connecting the pair of first grooves 15*a*. A pair of connecting pawls 16 (referred to as first pawls) formed on the outer circumference of the circular plate portion 1*b* of the driving scroll 1 at a 180° symmetrical positions are respectively engaged with the first grooves so as to be slidable in the radial direction. A pair of connecting pawls 17 (referred to as second pawls) formed on the outer periphery of the circular plate portion 2*b* of the driven scroll 2 at 180° symmetrical positions are respectively engaged with the second grooves 15*b* so as to be slidable in the radial direction. With this construction, when the driving scroll 1 is rotated, a rotating force from the driving scroll 1 is transmitted to the driven scroll 2 by causing an eccentric movement between the both scrolls 1, 2.

The inner diameter of the Oldham's coupling 15 is made slightly greater than the sum of the radius of the driving scroll 1, the radius of the driven scroll 2 and the distance between the both centers of rotation of the scrolls.

Referring to FIG. 1, a partition plate 18 is fixed to the container 6 to separate a discharging chamber 19 from a section containing scrolls 1, 2. The partition plate 18 presses down the movable bearing support 12 through a number of thrust bearing balls 20 which are arranged in a plurality of rows with reference to the circumferential direction of the partition plate 18. A discharge hole 18*a* is formed at the center of the partition plate 18 to communicate the discharge port 2*c* with the discharging chamber 19. A check valve 21 attached to the partition plate 18 prevents a reverse flow of a highly pressurized gas when the compressor is stopped. The check valve 21 comprises a valve 22 fixed to the partition plate by means of a rivet 23. A reference numeral 24 designates a rotary mechanical seal mounted on the shaft 5 for the driven scroll, a numeral 25 designates a fixed mechanical seal which is attached to the partition plate 18 and is in contact with the rotary mechanical seal 24 to prevent leakage of the compressed gas, a numeral 26 designates a tip seal fitted in a spiral groove 1*c* formed in the top end surface of the wrap plate 1*a* and a numeral 27 designates a tip seal fitted in a spiral groove 2*d* formed in the top end surface of the wrap plate 2*a*.

A motor 28 as a driving source comprises a stator iron core 29 firmly attached to the container 6 and holds a stator coil 30, and a rotor 31 firmly attached to a driving shaft 4.

The discharge pipe 34 is connected to the container 6 to introduce the pressurized gas in the discharging chamber 19 to the outside of the compressor.

Figure 3:
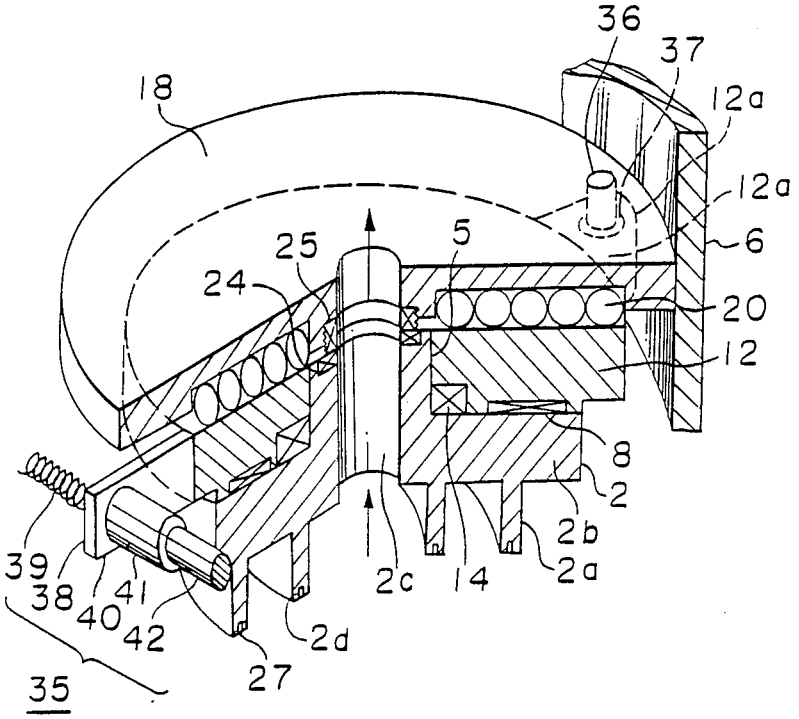
FIG. 3 is a perspective view partly broken of a movable bearing support shown in FIG. 1.
Figure 4:
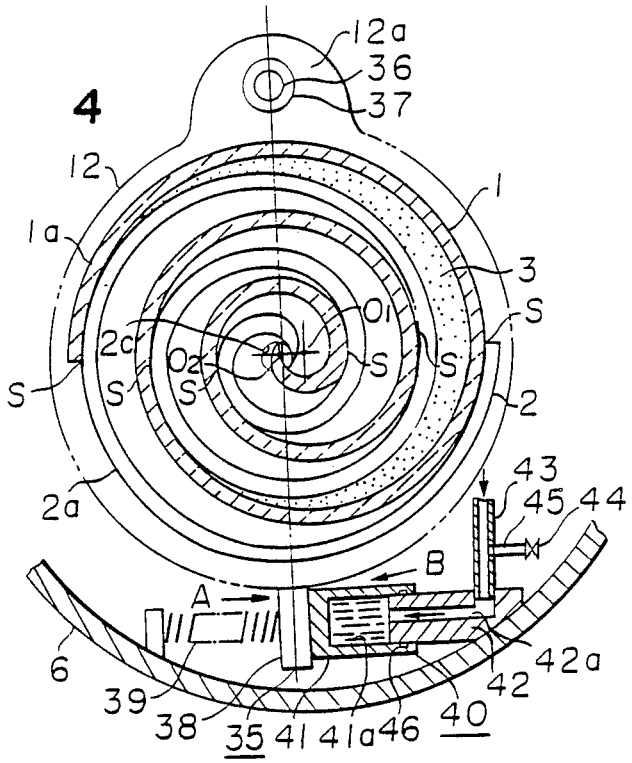
FIG. 4 is a diagram showing a rotation controlling means for the movable bearing support shown in FIG. 1.

FIGS. 3 and 4 show an embodiment of the rotation controlling means for the movable bearing support 12. A numeral 35 designates the rotation controlling means as a whole. A support pin 36 is fixed on the partition plate 18 at a position near the outer circumference of the plate, and is fitted into a bearing 37 which is in turn fitted into a boss 12*a* provided at the outer circumference of the movable bearing support 12 so that the movable bearing support 12 is turnable around the fitting point. An extension 38 is provided at the outer circumference of the movable bearing support 12 at a position diametrically opposing the supporting pin 36. A coil spring 39 is interposed between a surface of the extension 38 and the inner wall of the container 6 to push the extension 38 in the direction indicated by an arrow mark A whereby the axial center $0_2$ of the driven scroll 2 is caused to come closer to the axial center $0_1$ of the driving scroll 1 through the movable bearing support 12.

A hydraulic cylinder 40 is disposed in the container 6 and has a construction as follows. A cylinder 41 is fixed to the other side of the extension 38. A piston rod 42 is slidably fitted in the cylinder 41 and the free end of the piston rod is connected to the inner wall of the container 6. A conduit 42*a* is formed in the piston rod 42 and a pressurized gas feeding pipe 43 is connected to the conduit 42*a* to feed a pressurized gas produced by the operation of the scrolls. A safety valve 44 is provided in a branched pipe connected to the feeding pipe 43. When an abnormally high pressure gas is produced, the safety valve is opened to reduce the gas pressure to the cylinder 40. A numeral 46 designates an O-ring.

The operation of the scroll compressor according to the above-mentioned embodiment will be described.

Figure 6:
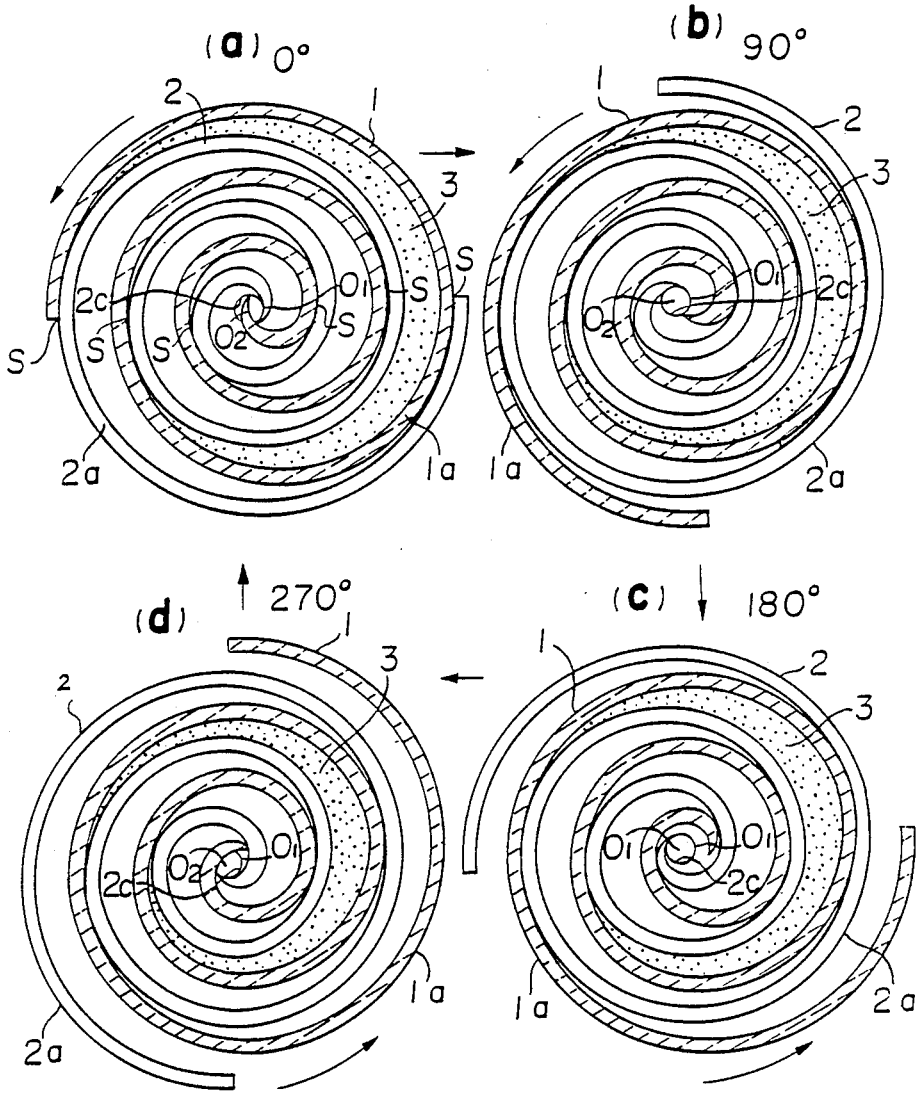
FIGS. 6(*a*) through 6(*d*) are diagrams showing the principle of the operation of a typical total system rotation type scroll compressor.

On actuation of the motor 28, the driving scroll 1 is rotated around the axial center $0_1$, hence, the driven scroll 2 is rotated around the axial center $0_2$ through the Oldham's coupling 15. The associated revolution of the both scrolls effects a series of operations of suction, compression and discharge of gas as described with reference to FIG. 6.

During the rotation of the driving and driven scrolls 1, 2, a gas is sucked through the intake tube 33 to be introduced into the compression chamber 3 from the outer circumference of the scrolls 1, 2. The compression chamber 3 moves toward the centers of the scrolls in accordance with a synchronizing revolution of the wrap plates 1*a*, 2*a*. The gas in the compression chamber 3 is gradually compressed and then, is discharged through the discharge ports 2*c*. Then, the gas is introduced into the discharging chamber 19 through the check valve 21, where pulsation of the pressurised gas is removed, followed by being forcibly supplied to the outside from the discharge pipe 34. The tip seals 25, 26 provided in the grooves of the wrap plates 1*a*, 2*a* are to seal the contacting surfaces to prevent leakage of the pressurized gas.

The gas sucked through the intake pipe 32 is to cool the motor 28 although the detail of the construction is omitted in the figures.

Figure 2:
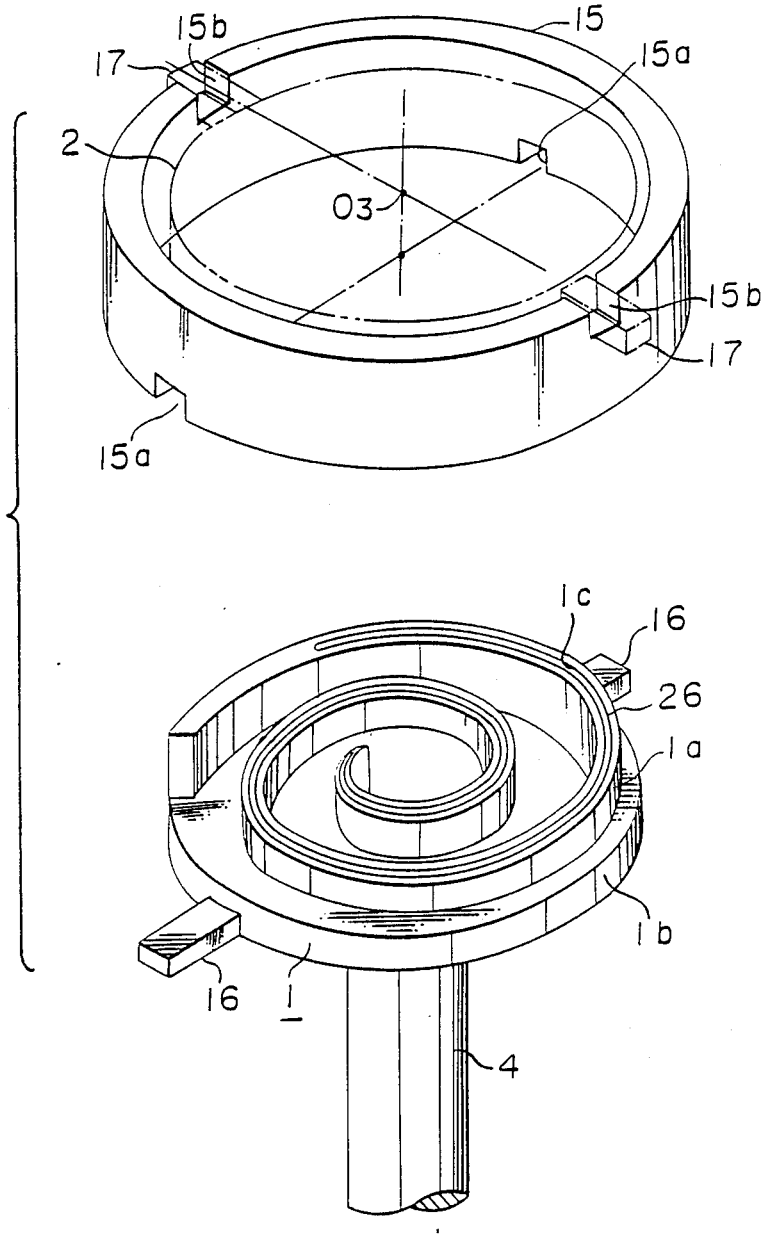
FIG. 2 is an exploded perspective view showing an embodiment of an Oldham's coupling shown in FIG. 1.

The Oldham's coupling 15 rotates around its own axial center $0_3$ during the operation as shown in FIG. 2. The axial center $0_3$ also rotates around the middle point between the axial center $0_1$ of the driving scroll 1 and the axial center $0_2$ of the driven scroll 2. Since there are some spatial deviation between $0_1$ and $0_3$ and between $0_2$ and $0_3$, relative movements are caused between the first pawl 16 and the first groove 15*a* of the Oldham's coupling 15, and between the second pawl 17 and the second groove 15*b* of the Oldham's coupling 15 in the range corresponding to the distance $\overline{0_1 0_2}$, although the movements are small.

The operation of the rotation controlling means 35 for the movable bearing support will be described with reference to FIG. 4.

Generally, the distance $\overline{0_1 0_2}$, i.e., the distance between the axial center $0_1$ of the driving scroll 1 and the axial center $0_2$ of the driven scroll 2 is expressed by the following equation;

$$\overline{0_1 0_2} = p/2 - t$$

where p is the pitch of scrolls and t is the thickness of the wrap plates.

The function of the association of the spring 39 disposed at one side of the extension 38 of the movable bearing support 12 and the hydraulic cylinder 40 disposed at the other side, is to control the distance of $\overline{0_1 0_2}$ and to impart a pushing force to the sealing portions of the wrap plates 1*a*, 2*a* in their radial direction. For instance, when the scroll compressor is started, slight gaps should be produced in the sealing portions between the wrap plates 1*a*, 2*a* by giving a relation of $\overline{0_1 0_2} < p/2 - t$ to reduce a load. In this case, a pressure in the pressure chamber 41*a* of the cylinder 41 is reduced, whereby the movable bearing support 12 is slightly moved in the direction of the arrow marked A by the action of the spring 39 so that center $0_2$ moves toward the center $0_1$.

After the operation of the compressor has been started in the condition of a reduced load, the pressure of the compressed gas (or the oil pressure by the oil pump 32) is transmitted to the pressure chamber 41*a* of the cylinder 40 through the feeding pipe 43. Then, the inner pressure of the cylinder 41 moves the movable bearing support 12 in the direction indicated by an arrow marked B against the spring action of the spring 39. At this moment, a force of $F_1$–$F_2$ ($F_1$ is a pressure by the cylinder 41 and $F_2$ is a pressure by the spring 39) is applied to the movable bearing support 12 through the extension 38. By properly adjusting the fluid pressure applied to the cylinder 41 by means of an adjusting means (not shown), a sealing effect is imparted to the sealing portions s formed between the side surfaces of the wrap plates 1*a*, 2*a* in their radial direction, whereby leakage of the gas can be prevented during the compressing operations to thereby improve the efficiency of the compressor. Thus, troublesome adjusting operations during the assembling works become unnecessary because the gaps in the sealing portions s of the wrap plates 1*a*, 2*a* can be controlled.

When an abnormal pressure is produced in the gas which is introduced into the pressure chamber 41*a* of the cylinder 41, the safety valve 44 opens and the movable bearing support 12 is moved in the direction A by the spring action of the spring 39, whereby the driven scroll 2 is moved together, with the result that the gaps are produced at sealing portions s between the both scrolls 1, 2. Accordingly, the abnormal pressure in the compression chamber 3 is reduced and damage in the mechanical elements can be prevented.

It is preferable to determine the position of the extension 38 of the movable bearing support 12 at a position substantially perpendicular to an imaginary line passing through each sealing portion s of the wrap plates 1*a*, 2*a*, and in the direction of a vector applied to the driven scroll 2 with respect to the supporting pin 36. This is because the driven scroll 2 can maintain a position of sealing the sealing portions s by the fluid pressure in the compression chamber 3 when no spring action and gas pressure act on the extension 38 if there is any trouble.

In the above-mentioned embodiment, the distance between the axial centers of the driving and driven scrolls 1, 2 is controlled by moving the rotation controlling means 35 comprising the extension 35 formed in the movable bearing support 12. However, according to another embodiment, a rotation controlling means 50 may be used as shown in FIG. 5.

Figure 5:
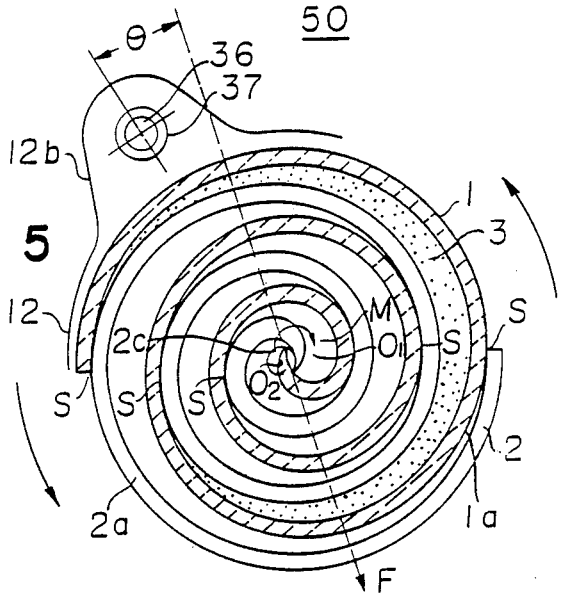
FIG. 5 is a diagram showing another embodiment of the rotation controlling means for the movable bearing support.

In FIG. 5, a boss 12*b* is provided in the outer circumference of the movable bearing support 12 at a position with a predetermined angle with respect to a line indicated by F, and the supporting pin 36 is inserted in the bearing 37 formed in the boss 12*b* so that the movable bearing support 12 is moved around the fitting point. In this embodiment, the extension 38 as provided in the embodiment shown in FIG. 4 is omitted.

In FIG. 5, both the force F resulted from compression gas and a moment M around supporting pin 36 are applied to the center of the driven scroll 2 the moment M being caused by gas pressure acting on the driven scroll. The magnitude of the moment M is as large as half of a compressing torque T (i.e., the torque required to compress gas) and is balanced by a force from the driving source such as the motor 28. That is, the torque of motor 28, acting in a direction opposite moment M, overcomes the reaction of the scrolls to the torque of M, so as to provide compression. The boss 12*b* is provided at the position inclined by an angle $\theta$ in the direction of rotation with respect to the line on the vector F and the supporting pin 36 is determined at that position for support, whereby a component of force for sealing the portions s is generated by the force F. The sealing force is controlled by the value of the angle $\theta$, which is based on the geometry of the scrolls.

Thus, the posture of the driven scroll can be maintained by providing the rotation controlling means 50 without using the rotation controlling means 35 with the extension 38 as shown in FIG. 4. Thus, the embodiment of the present invention shown in FIG. 5 provides the structure that permits the drive scroll 2 to be moved in its radial direction and to produce an effective sealing force during the operation of the compressor.

In the above-mentioned first embodiment, description has been made such that the pressure of the compressed gas produced in the compression chamber is used as a fluid pressure source for controlling the operation of the hydraulic cylinder 41. However, another fluid pressure source such as an oil pressure by the oil pump 32 may be used.

As described above, the embodiments of the present invention are so constructed that the driven scroll is rotated by the driving scroll through the Oldham's coupling; the driven scroll is supported by the movable bearing support which is in turn moved by the rotation controlling means, and the distance between the axial centers of the driving and driven scrolls is made adjustable. Accordingly, accuracy in the structural elements used in the compressor may be reduced, hence a permitted limit in the assembling work can be expanded and the assembling works can be easy. Further, productivity is improved and a highly efficient operation is obtainable.

What is claimed is:

1. A scroll compressor which comprises:

a sealing container, a driving scroll with a wrap plate, a driven scroll with a wrap plate, which is combined with said driving scroll to form a compression chamber therebetween, an Oldham's coupling for transmitting a driving force of said driving scroll to said driven scroll, a partition plate fixed to said container and having a supporting pin provided at a position near the inner wall of said container, a movable bearing support which supports said driven scroll, said movable bearing support being placed below said partition plate and having a bearing engaged with said supporting pin, the engagement between said supporting pin and said bearing comprising means for supporting said movable bearing support for swingable motion around said supporting pin, and a rotation controlling means which causes a swinging movement of said movable bearing support around said supporting pin along with said driven scroll whereby the distance between the axial centers of said driving and driven scrolls is changed, wherein said rotation controlling means has a center around which said movable bearing support is swung, the center of the controlling means being determined in such a position that it is opposite a vector of the compressing force acting on said driven scroll and at an angle deviated from the imaginary line on the vector in the direction of rotation of said driven scroll.

2. The scroll compressor according to claim 1, wherein a number of thrusting balls are interposed between said movable bearing support and said partition plate.

* * * * *

UNITED STATES PATENT AND TRADEMARK OFFICE

CERTIFICATE OF CORRECTION

PATENT NO. : 4,840,549

DATED : June 20, 1989

INVENTOR(S) : Etsuo MORISHITA, et al

It is certified that error appears in the above-identified patent and that said Letters Patent is hereby corrected as shown below:

On the Title Page, Item [30], the Priority Information has been omitted, it should read as follows:

--Feb. 12, 1986 [JP] Japan..... 61-28427--.

Signed and Sealed this

Fifteenth Day of May, 1990

*Attest:*

HARRY F. MANBECK, JR.

*Attesting Officer*

*Commissioner of Patents and Trademarks*